US008851303B2

(12) United States Patent
Crawbuck et al.

(10) Patent No.: US 8,851,303 B2
(45) Date of Patent: Oct. 7, 2014

(54) INTEGRATED SHELF ALLOCATION MANAGEMENT SYSTEM

(75) Inventors: Cynthia A. Crawbuck, Wexford, PA (US); James R. Burchell, North Versailles, PA (US); Edward J. Moss, Pittsburgh, PA (US); John C. Burchell, North Versailles, PA (US)

(73) Assignee: Smart Systems, Inc., Pittsburgh, PA (US)

( * ) Notice: Subject to any disclaimer, the term of this patent is extended or adjusted under 35 U.S.C. 154(b) by 624 days.

(21) Appl. No.: 12/511,872

(22) Filed: Jul. 29, 2009

(65) Prior Publication Data

US 2010/0025346 A1 Feb. 4, 2010

Related U.S. Application Data

(60) Provisional application No. 61/084,536, filed on Jul. 29, 2008.

(51) Int. Cl.

| | |
|---|---|
| ***A47F 1/04*** | (2006.01) |
| ***A47F 7/00*** | (2006.01) |
| ***A47F 1/12*** | (2006.01) |

(52) U.S. Cl.

CPC .. *A47F 1/126* (2013.01); *A47F 1/12* (2013.01)
USPC ..... 211/59.3; 211/59.2

(58) Field of Classification Search

CPC ..... A47F 1/125; A47F 1/126
USPC ..... 211/59.3, 175, 184, 90.02, 150, 59.2, 211/43, 126.1; 108/102
See application file for complete search history.

(56) References Cited

U.S. PATENT DOCUMENTS

| | | | | |
|---|---|---|---|---|
| 202,230 | A | | 4/1878 | Chapman |
| 779,262 | A | | 1/1905 | Burke |
| 1,702,987 | A | * | 2/1929 | Wilson ..... 211/59.3 |
| 4,036,369 | A | | 7/1977 | Eisenberg |
| 4,155,312 | A | | 5/1979 | Thorkildson |
| 4,460,096 | A | * | 7/1984 | Ricci ..... 211/184 |
| 4,478,337 | A | * | 10/1984 | Flum ..... 211/59.2 |
| 4,504,100 | A | * | 3/1985 | Chaumard ..... 312/71 |
| 4,564,118 | A | | 1/1986 | Heyer et al. |
| 4,589,349 | A | | 5/1986 | Gebhardt et al. |
| 4,627,542 | A | | 12/1986 | Fredrickson |
| 4,997,094 | A | * | 3/1991 | Spamer et al. ..... 211/153 |
| 5,096,272 | A | | 3/1992 | Belokin, Jr. et al. |
| 5,111,942 | A | * | 5/1992 | Bernardin ..... 211/59.3 |

(Continued)

OTHER PUBLICATIONS

Notification of Transmittal of the International Search Report and the Written Opinion of the International Searching Authority, or the Declaration for PCT Application serial No. PCT/US2013/072003, Mar. 13, 2014.

*Primary Examiner* — Darnell Jayne
*Assistant Examiner* — Kimberley S Wright
(74) *Attorney, Agent, or Firm* — Beck & Thomas, P.C.

(57) ABSTRACT

Apparatuses for the efficient and safe organization of product on shelves. The present invention encompasses shelving allocation units that are adjustable in both the longitudinal and orthogonal direction. By being adjustable along an orthogonal axis, the shelving allocation units of the present invention may be adapted to accommodate various sizes of product. The present invention also includes novel backstop assemblies that may be adapted for use in shelves of various dimensions. The present invention may also include a gravity- or spring-driven bias mechanism to drive product automatically to the front of the assembly.

16 Claims, 10 Drawing Sheets

(56) References Cited

U.S. PATENT DOCUMENTS

| | | | | |
|---|---|---|---|---|
| 5,240,126 | A * | 8/1993 | Foster et al. | 211/59.3 |
| 5,366,099 | A | 11/1994 | Schmid | |
| 5,413,229 | A * | 5/1995 | Zuberbuhler et al. | 211/59.3 |
| 5,458,248 | A * | 10/1995 | Alain | 211/175 |
| 5,469,976 | A | 11/1995 | Burchell | |
| 5,542,552 | A * | 8/1996 | Yablans et al. | 211/59.3 |
| 5,806,690 | A | 9/1998 | Johnson et al. | |
| 5,855,283 | A * | 1/1999 | Johnson | 211/59.3 |
| 6,105,791 | A * | 8/2000 | Chalson et al. | 211/59.3 |
| 6,155,437 | A * | 12/2000 | Rassent | 211/59.3 |
| 6,357,606 | B1 * | 3/2002 | Henry | 211/59.3 |
| 6,523,702 | B1 | 2/2003 | Primiano et al. | |
| 6,527,127 | B2 * | 3/2003 | Dumontet | 211/59.3 |
| 6,615,995 | B2 | 9/2003 | Primiano et al. | |
| 6,655,538 | B2 * | 12/2003 | Saulnier-Matteini | 211/153 |
| 6,685,037 | B1 | 2/2004 | Zadak | |
| 6,691,891 | B2 * | 2/2004 | Maldonado | 221/279 |
| 6,695,152 | B1 | 2/2004 | Fabrizio et al. | |
| 6,719,152 | B1 * | 4/2004 | Nagel et al. | 211/59.3 |
| 6,769,552 | B1 * | 8/2004 | Thalenfeld | 211/59.3 |
| 6,779,670 | B2 | 8/2004 | Primiano et al. | |
| 6,964,235 | B2 * | 11/2005 | Hardy | 108/61 |
| 7,168,579 | B2 * | 1/2007 | Richter et al. | 211/59.3 |
| 7,395,938 | B2 * | 7/2008 | Merit et al. | 211/59.4 |
| 7,458,473 | B1 * | 12/2008 | Mason | 211/59.3 |
| 7,641,057 | B2 * | 1/2010 | Mueller et al. | 211/59.3 |
| 7,681,745 | B2 * | 3/2010 | Richter | 211/59.3 |
| 7,690,519 | B2 * | 4/2010 | Kahl et al. | 211/59.2 |
| 7,784,623 | B2 * | 8/2010 | Mueller et al. | 211/59.3 |
| 8,038,017 | B2 * | 10/2011 | Close | 211/59.3 |
| 8,066,128 | B2 * | 11/2011 | Crawbuck et al. | 211/59.3 |
| 8,113,360 | B2 * | 2/2012 | Olson | 211/59.3 |
| 2003/0024889 | A1 * | 2/2003 | Dumontet | 211/59.3 |
| 2003/0132181 | A1 | 7/2003 | Saulnier-Matteini | |
| 2004/0011754 | A1 | 1/2004 | Zadak | |
| 2004/0245197 | A1 | 12/2004 | McElvaney | |
| 2005/0092703 | A1 * | 5/2005 | Mueller et al. | 211/59.3 |
| 2005/0098515 | A1 * | 5/2005 | Close | 211/59.3 |
| 2005/0139560 | A1 | 6/2005 | Whiteside et al. | |
| 2005/0258113 | A1 * | 11/2005 | Close et al. | 211/59.3 |
| 2006/0186065 | A1 * | 8/2006 | Ciesick | 211/59.3 |
| 2007/0068885 | A1 * | 3/2007 | Busto et al. | 211/59.3 |
| 2007/0095772 | A1 | 5/2007 | Hardy | |
| 2007/0175840 | A1 * | 8/2007 | Richter | 211/59.3 |
| 2007/0175845 | A1 * | 8/2007 | Hardy | 211/184 |
| 2007/0194037 | A1 * | 8/2007 | Close | 221/100 |
| 2008/0142458 | A1 * | 6/2008 | Medcalf | 211/59.3 |
| 2008/0156752 | A1 * | 7/2008 | Bryson et al. | 211/59.3 |
| 2009/0057254 | A1 * | 3/2009 | Crawbuck et al. | 211/162 |
| 2010/0025346 | A1 * | 2/2010 | Crawbuck et al. | 211/59.3 |
| 2010/0096345 | A1 * | 4/2010 | Crawbuck et al. | 211/59.3 |
| 2011/0210086 | A1 * | 9/2011 | Ciesick | 211/59.3 |

* cited by examiner

INTEGRATED SHELF ALLOCATION MANAGEMENT SYSTEM

The present application claims the benefit under 35 U.S.C. 119(e) of U.S. Provisional Application No. 61/084,536 filed Jul. 29, 2008. The present application claims the benefit under 35 U.S.C. 120 of U.S. Utility application Ser. No. 11/846,355 filed Aug. 28, 2007, published as U.S. Patent Application Publication No. 2009/0057254 as a continuation-in-part.

BACKGROUND OF THE INVENTION

1. Field of the Invention

The present invention relates generally to systems for managing and allocating shelf space among rows of products. More particularly, the present invention is directed to integrated shelf allocation management systems with single and/or dual adjustability to accommodate varying shelf depths and varying product sizes easily.

2. Description of the Background

In retail stores, such as grocery stores, products are displayed on shelves for customers to inspect and select. In order to attract customers to a particular product and/or to facilitate a convenient shopping experience, these products must be organized in an orderly fashion on the store shelves. Moreover, because wasted shelf space wastes money, the products should efficiently use shelf space, even where disparate size shelves are utilized.

For orderly customer presentation, products may be divided into rows with dividers between rows so that each product row remains confined to a designated area and does not shift or cross over into another row. Further, these dividers may be adjustable in length so that they may accommodate varying shelf depths.

Additionally, vendors prefer to move the products to the front of the shelf so that the customer may easily view the products or reach them for purchase. If the products are hidden at the back of the shelf, the customer may not see or be able to reach them resulting in loss of potential sales. Display of the products in a disorderly fashion may also result in loss of sales.

Traditional shelving systems address one or more of these issues. One class of existing systems involves complex machinery which advances products to the front of the shelf using some type of biasing mechanism. Machines are limited to a specific shelf depth and are not easily adjusted to accommodate all shelving depths. Ultimately, these systems fail to maximize the use of store shelf space.

Other traditional systems involve less complex machinery, such as dividers that are separately attached to either the shelf itself or to locating strips that run lengthwise along the front of the shelf. Due to the separated nature of the dividers, these systems lack the structural stability of an integrated unit in which both side walls are joined by a base piece that runs therebetween. As a result, the dividers may fail to provide a rigid enough barrier to confine products to one particular row. Further, the permanent or semi-permanent nature of the attachment of the dividers to the shelf makes it difficult to reposition the dividers in these systems to accommodate varying product shapes and sizes. To accomplish such task, each divider is manually removed from either the shelf itself or a locating strip, repositioned, and reattached at a new position on the shelf or locating strip. That step can be both time consuming and inconvenient.

There has been a long standing need in the commercial vendor community for systems that allow for single and/or dual adjustability (width-wise and depth-wise) within an integrated unit to accommodate varying shelf depths and varying product sizes. Such a product would preferably maintain sufficient rigidity to align rows of products appropriately, while preferably displaying product toward the front of the shelf.

SUMMARY OF THE INVENTION

In accordance with at least one preferred embodiment, the present invention provides apparatuses for the safe and efficient organization of product on shelves. In some embodiments, the present invention encompasses shelving allocation units that are adjustable in both the longitudinal and orthogonal directions. The shelving allocation units of the present invention are thus able to accommodate varying shelf depths by adjustment in the longitudinal direction and accommodate various sizes of product by adjustment in the orthogonal direction.

The shelving allocation units of the present invention may include multiple components that are adapted to be coupled to one another to form the shelving allocation unit which will have a base, at least two side walls, and barrier elements at the front and rear ends. The components are preferably adapted to couple to each other so that the entire assembly is adjustable along both the longitudinal direction (to accommodate varying shelf depths) and in the orthogonal direction (to accommodate various product sizes or product widths).

The present invention is also preferably capable of employing a backstop assembly. The backstop assemblies of the present invention allow customers and store personnel to draw product from the rear towards the front of the shelving allocation unit. The backstop assemblies of the present invention include a rear plate that engages the product, a base, and a puller member that is adapted to engage the front of the base of the backstop assembly. In some preferred embodiments, the puller assembly includes a central channel that is adapted to loosely accommodate the puller member. The front of the base of the backstop assembly may be engaged by the puller member when the backstop assembly is drawn towards the front of the shelf and may be designed to accommodate a variety of shelving depths.

Each embodiment of the present invention may also include a spring-driven mechanism that draws product to the front of the assembly. Other presently preferred embodiments may employ a gravity-driven mechanism in which product is passively drawn to the front of the assembly.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

It is to be understood that the figures and descriptions of the present invention have been simplified to illustrate elements that are relevant for a clear understanding of the invention, while eliminating, for purposes of clarity, other elements that may be well known. The detailed description will be provided herein below with reference to the attached drawings.

The present invention, through its use of an integrated unit made up of a base and side walls having dual adjustability of this integrated unit addresses the limitations currently existing within the vendor community in order to provide a cost-effective integrated shelf allocation management system. Such a system preferably provides structural stability; can be easily placed on, moved, or removed from the shelf due to its integrated form; is quickly and easily adjustable to varying shelf depth and products shapes and sizes; and can efficiently advance products toward the front of the shelf for customer inspection and selection via the one or more preferred embodiments described herein.

As used herein, the "front" of the integrated shelf allocation management system refers to the portion resting on that part of the shelf surface closest to the aisle where a customer may easily view and/or select a product. The "rear" of the system refers to the portion resting of that part of the shelf surface farthest away from the aisle.

Figure 1:
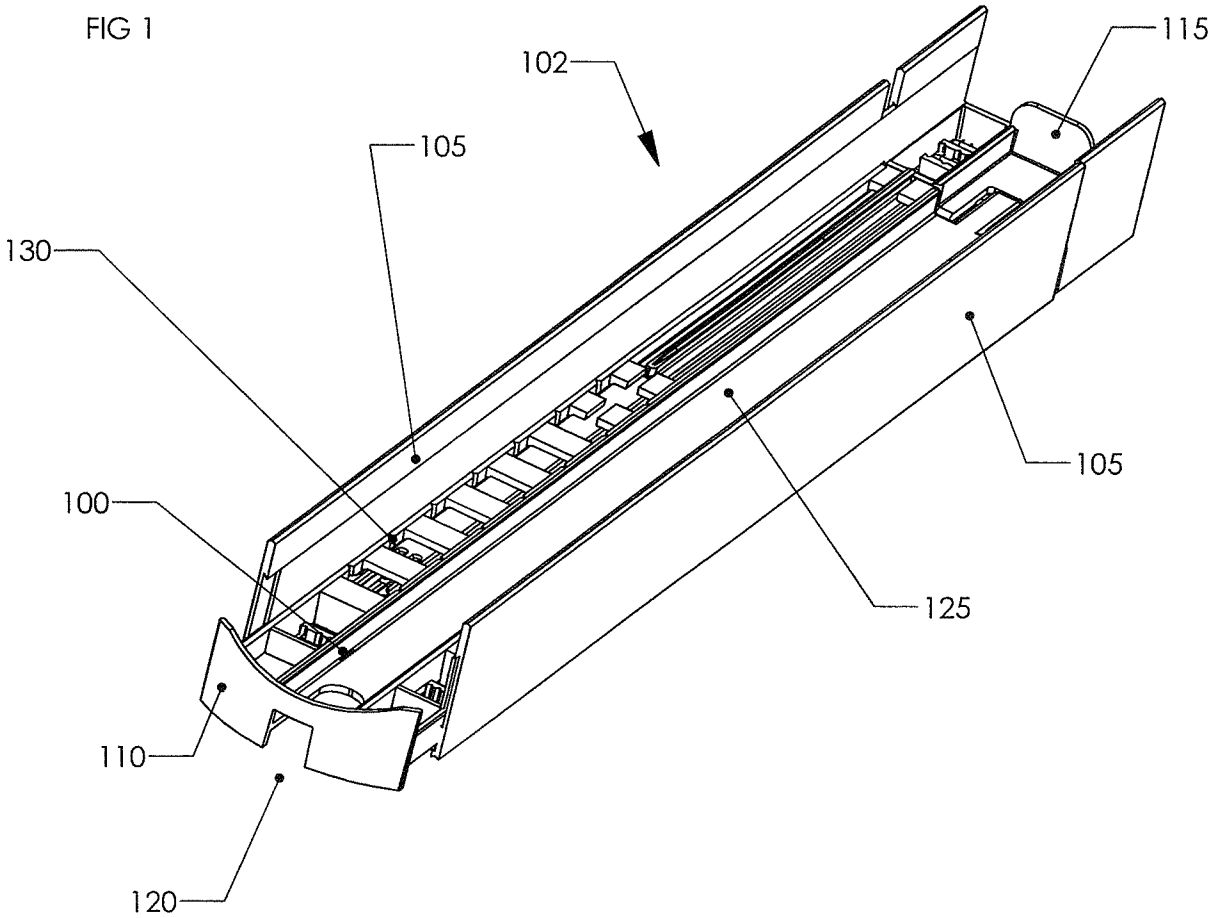
FIG. 1 is a view of the assembled shelving unit of the present invention.

FIG. 1 shows an embodiment of the integrated shelf allocation system as an integrated assembly 102. The integrated shelf allocation management system 102 allocates space along a retail store shelf among rows of product. The integrated shelf allocation management system 102 also provides for the movement of product toward the front of the shelf as described hereinbelow.

The integrated shelf allocation management system 102 of FIG. 1 generally includes a base 100 which runs along a longitudinal axis, at least two side walls 105, a front barrier element 110, and a rear barrier element 115. Each side wall 105 is located on opposing edges of the base 100 and extends vertically at approximately a 90 degree angle from the base 100. Side walls at a different angle may be used to accommodate various types of products.

Any number of commonly available manufacturing techniques may be used to join the two adjacent side walls 105 to the base 100 to form an integrated unit. In certain presently preferred embodiments, the present invention includes a pair of raised rails 130 that may support product that is placed into the assembly 102. Together, those raised rails 130 define a central channel 125 into which a puller assembly may be placed as described in greater detail hereinbelow. In certain presently preferred embodiments, the central channel 125 leads to an opening 120 in which the puller assembly may be partial disposed.

The systems of the present invention form an integrated assembly 102 in which the side walls 105 are at least partially integrated with the base 100 as described further hereinbelow. Further, the size and shape of the shelf allocation system 102 is preferably telescopically adjustable depth-wise (front to back) to accommodate shelves of different depths as well as width-wise to accommodate products of different widths.

As used herein, the term "telescopically" refers to the manner by which a side wall and a base extends or contracts within itself to allow such side wall and base to adjust either in a direction along a longitudinal axis or an orthogonal axis much as a telescope extends or contracts by the sliding of overlapping sections to vary its length.

As used herein, the term "integrated" means that the recited components remain selectably engaged as a single unit regardless of the chosen position. For example, when the shelf allocation management system is adjusted in a longitudinal direction (i.e., along the long axis of the device) to accommodate varying shelf depths, both the side walls 105 and base 100 are simultaneously extended in the same lengthwise direction. Although the side walls 105 and base 100 independently separate to accommodate this lengthwise extension, the base 100 and side walls 105 remain engaged as one integrated unit.

The integrated unit arrangement of the side walls and base provides overall structural stability to the shelf allocation management system including, but not limited to, enhanced structural strength of the side walls to firmly hold the products in place within each row. Further, this integrated arrangement allows the shelf allocation management system to be easily placed on, moved, or removed from the shelf as one integrated unit.

Each side wall 105 preferably forms a divider between product rows. This divider between product rows allows any individual row of product to be advanced on the shelf independent of any adjacent row of product while improving the utilization of the shelf width. The side wall 105 additionally prevents product damage from adjacent rows of products and also separates different types of products from one another.

FIG. 1 illustrates that a front barrier element 110 may be included at the front end of the integrated shelf allocation management system, thereby providing a physical stop to contain product within the assembly 102. Similarly, a rear barrier element 115 serves as a physical stop to prevent product from falling out of the rear of the assembly 102. The dimensions of the barrier elements and side walls may vary and may be selected to accommodate products having diverse dimensions.

Products are preferably positioned between the side walls 105 and are supported on a raised portion of the base 100. When installed on top of existing shelving, the present invention preferably supports the product off of the shelf surface thus providing a greater degree of airflow underneath the products which may maintain a more uniform temperature within the product.

Figure 2:
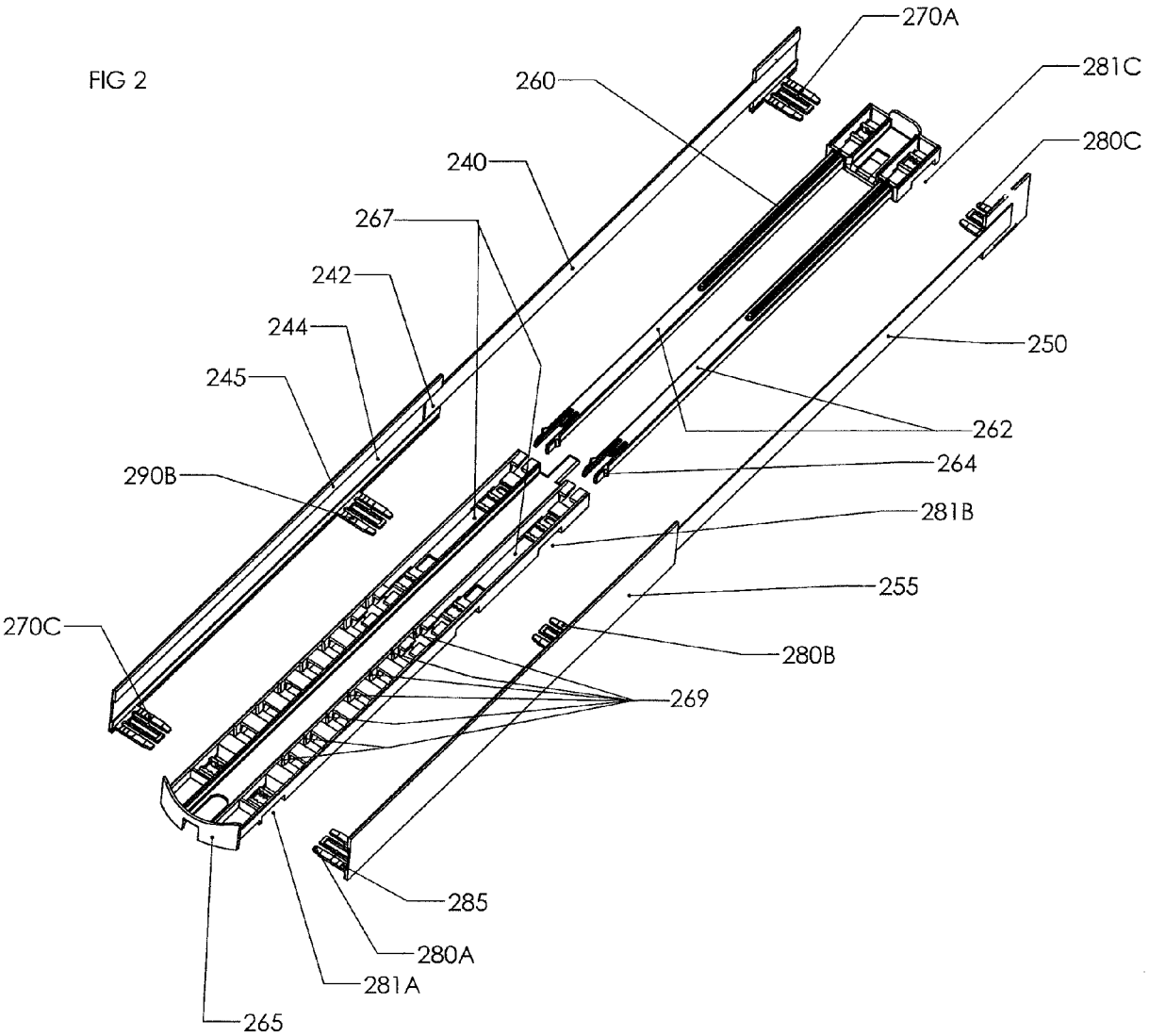
FIG. 2 is a view of the dissembled shelving unit of the present invention.

FIG. 2 shows a dissembled shelving allocation unit of the present invention particularly displaying the multi-component nature of the present invention. The system preferably includes two components 240, 245 that form the left side wall of the assembly and two components 250, 255 that form the right side wall of the assembly. In addition, two components 260, 265 form a base of the assembly. The components that form the side walls (i.e., 240, 245 and 250, 255) telescopically engage each other to form side wall components. For example, component 240 includes a portion 242 that fits into a complementary channel 244 located in component 245 such that the combined length of components 240 and 245 may be adjusted by sliding 240 into and out of component 245. Components 250 and 255 interact in a similar manner.

Components 260 and 265 are also adapted to be integrated with one another to form the base of the shelving allocation unit of the present invention. Components 260 and 265 further define a central channel in which the backstop assembly may be disposed, as described more fully hereinbelow. In certain presently preferred embodiments, component 260 includes two rails 262 that are adapted to fit into two complementary channels 267 in component 265. The ends of the rails preferably include extensions 264 that increase the width of the end of the rail. The extensions thus preferably make the width of the rails slightly greater than the channels 267. At certain predefined points, component 265 preferably includes notches 269. The notches 269 are designed to accommodate the extensions 264 and lock components 260 and 265 into a set longitudinal distance. The notch 269 and extension 264 system thus provide a convenient mechanism by which a user may set a longitudinal depth of the shelving allocation systems of the present invention. Further, in this manner components 260 and 265 form an integrated base component.

The present invention further provides for the integration of the side wall components (i.e., integrated components 240, 245 and integrated components 250, 255) into the base component to form a full shelving allocation unit. In presently preferred embodiments, the coupling of the side wall components with the base component is accomplished through a series of width adjustment tabs 270A, 270B, 270C and 280A, 280B, 280C and complementary grooves 271A, 271B, 271C and 281A, 281B, 281C. With regards to a single width adjustment tab 280A and groove 281A, the width adjusting tab 280A is designed to fit snugly into groove 281A thus integrating the side wall components with the base component to form a single integrated shelving allocation unit of the present invention. The width adjusting tabs may be inserted to variable distances into the grooves, thus allowing the user to set the width of the assembly to accommodate the particular product to be stored in the shelving allocation unit. In certain presently preferred embodiments the width adjustment tabs include guide lines 285 that allow the user to set the degree of penetration of each of the width adjustment tabs into the grooves to a consistent depth. One of skill in the art will recognize other mechanisms and techniques that may be employed for coupling of components of the present invention.

During use of the present invention, the side wall components 240, 245 and 250, 255 are preferably initially integrated to one another and are then integrated with the base components 260, 265 through the width adjustment tabs and grooves. The longitudinal length of the integrated shelving allocation unit may then be adjusted through the extension and notch mechanism found in components 260, 265.

A backstop assembly 300 may be positioned between the side walls in any embodiment of the present invention as described. The backstop assembly 300 is moveable along the longitudinal axis of the assembly and is adapted to engage and advance a row of products within the shelving unit. The backstop assembly 300 shown in FIG. 3 may be used by customers as well as store personnel to pull products from the rear of an integrated shelf assembly of the present invention towards the front. This style of backstop would allow customers and store personnel to obtain product that they might otherwise be unable to reach or see in the rear of the shelf. The backstop assembly 300 may run on tracks located on the base of the assembly (see, e.g., 130), thereby allowing the backstop assembly 300 to be smoothly drawn towards the front of the assembly.

Figure 3:
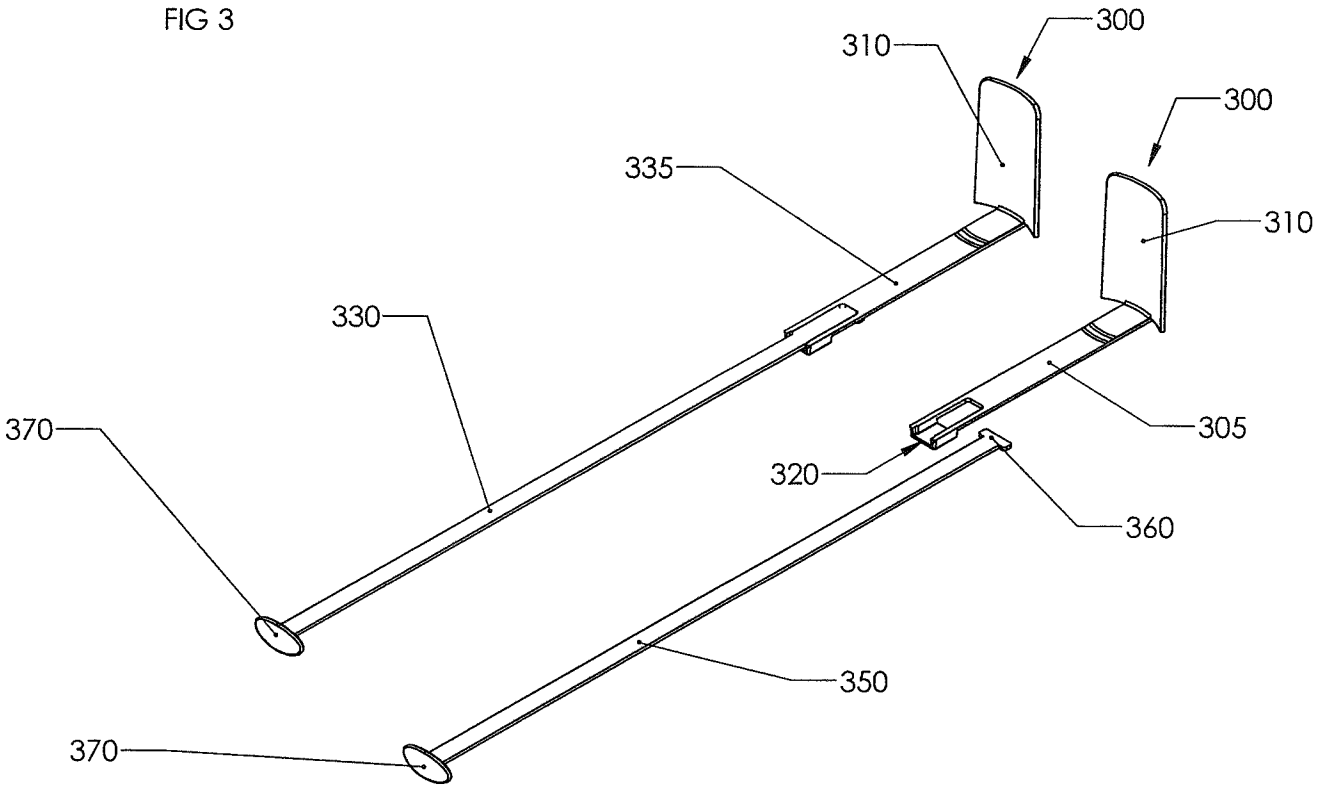
FIG. 3 illustrates a perspective view of an embodiment of the backstop assembly of the present invention.

FIG. 3 illustrates the structure of the backstop assembly 300 and its relationship to the puller member 350. The backstop assembly includes a backstop base 305 and a backstop plate 310. As shown in FIG. 3, these two elements are fabricated as a single piece. In other presently preferred embodiments, these two elements may be made up of two separate pieces of material that are fused or glued together at a later time. In some embodiments, the backstop assembly 300 includes ribs (not shown) on the underside of the backstop base 305 that stabilize the backstop assembly against rotation, thereby improving the ability of the backstop assembly to draw product towards the front of the shelving unit.

A central backstop channel 320 is present at the front of the backstop base 305 to accommodate the puller member 350. The puller member 350 is appropriately sized so as to move forwards and backwards through the central backstop channel 320 with limited restriction. The rear end of the puller member includes an engaging portion 360 which is preferably larger than the central backstop channel 320 such that the engaging portion 360 engages the front portion of the backstop assembly 300 to move the backstop assembly 300 forward. The engaging portion 360 is large enough in size so as to not dislodge from the backstop assembly 300 while it is moving the backstop assembly toward the front of the shelving allocation unit. As shown, the puller member 350 engages the backstop assembly 300 in its front portion 330, thereby allowing the puller member 350 and backstop assembly 300 to have an effective reach that approximates the entire length of the backstop assembly 300 plus the puller member 350. In addition, the front portion 330 of the backstop assembly preferably is slightly angled forward to form a ramp. That ramp allows product to transition easily from the base of the shelving allocation unit to the base of the backstop 305.

In some preferred embodiments, a gripping element 370 is secured to the front end of the puller member 350. A variety of gripping elements may be attached to the front of the puller member. This gripping element 370 may be fashioned in various manners, including a simple hole, a knob, or an upturned portion of the puller member, convenient for grasping with the fingers. The gripping element 370 may also include an advertisement or instructions for the customer (e.g., "Pull Here"). This puller member could also be implemented using other commonly known structures.

Figure 4:
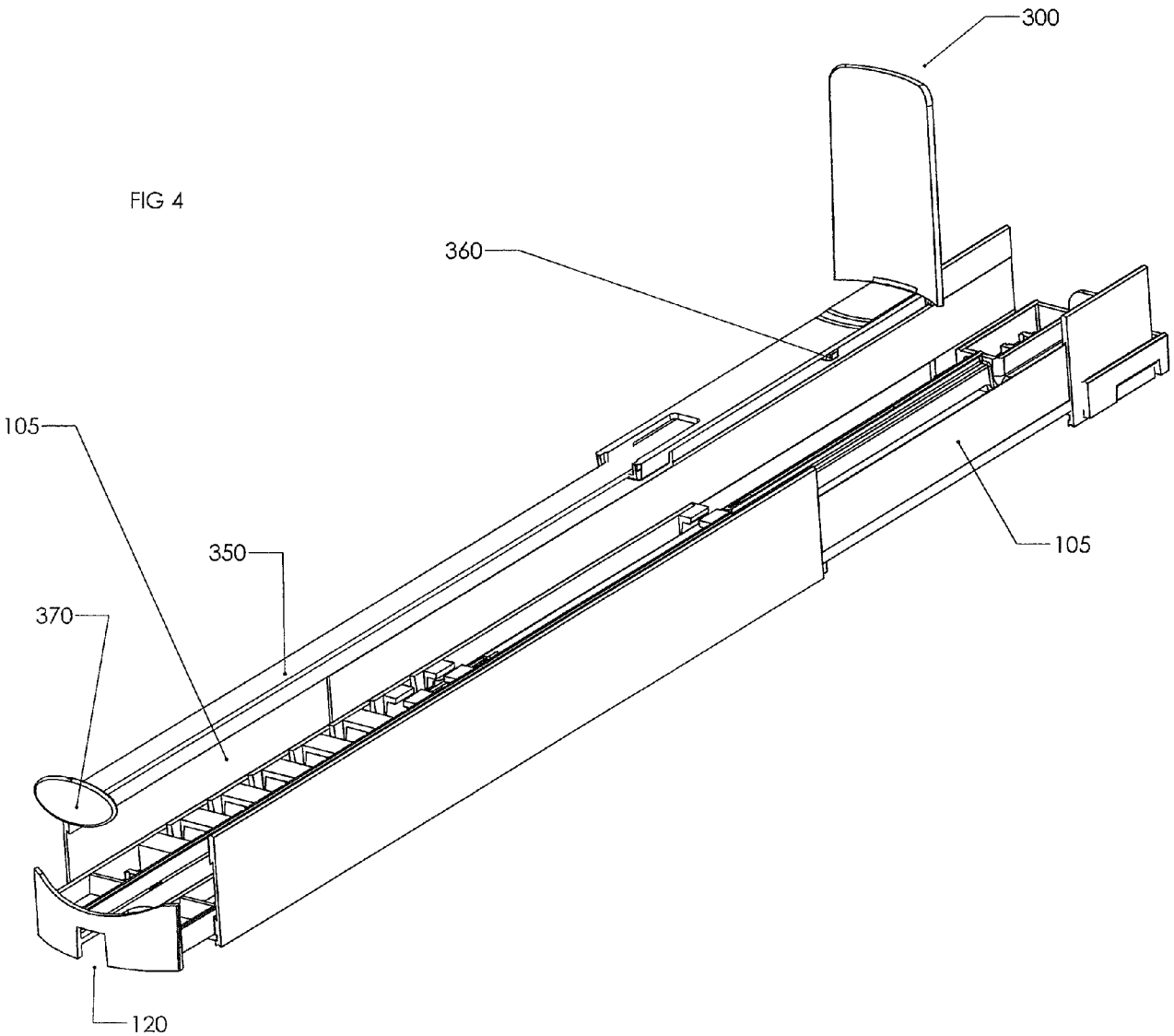
FIG. 4 shows a backstop assembly (including puller member) incorporated into a shelving allocation system of the present invention.

FIG. 4 shows how the backstop assembly 300 (including puller member 350) as illustrated by FIG. 3 may be incorporated into any of the embodiments of the present invention such that products of varying dimensions may be advanced to the front of the shelf. Other embodiments of backstop assemblies useful within the context of the present invention may be found in U.S. Pat. No. 5,469,976, which is hereby incorporated by reference.

In certain preferred embodiments, the puller member 350 resides within a central channel 125 that runs down the middle of the longitudinal axis of the shelving allocation unit. That location of the puller allows the product to rest above the central channel 125, thus further allowing the product to slide easily along the center of the shelving allocation units of the present invention.

As the products are removed from the row, the store customer or store personnel will advance the row of products towards the front of the assembly by moving the puller member 350 towards the front of the assembly using the gripping element 370. As the puller member 350 is advanced towards the front of the assembly, the engaging portion 360 may be abutted against the central backstop channel 320 engaging the backstop assembly 300 to advance the row of products towards the front of the assembly. Once that step has been accomplished, the customer or stock person may then push the puller member 350 towards the rear of the assembly using the gripping element 370. Because the puller member 350 is only slideably related to the backstop assembly 300 through the central backstop channel 320, in its backward movement the puller member 350 will experience minimal resistance from either the backstop assembly 300 or from the products. Thus, the puller member 350 may be pushed backward without disturbing the backstop assembly 300 or the products until the puller member 350 is conveniently stowed.

This process may be repeated as often as needed until the row of products is exhausted. When the row of products has been exhausted or when restocking is necessary, the backstop assembly 300 can be manually pushed toward the rear of the assembly and new products inserted. The present invention may also include a bias mechanism, such as a spring-based mechanism, by which the backstop assembly 300 may be automatically drawn toward the front of the assembly as product is withdrawn from the unit. One of ordinary skill in the art will recognize multiple manners in which such a bias mechanism could be implemented. Such bias mechanisms are more full described hereinbelow.

A further advantage of the shelving allocation units of the present invention includes the ability of store personnel to restock shelves with product from the front of the shelf. Specifically, store personnel may place the product in the front of the shelving allocation unit and push back earlier-stocked product towards the rear, thus avoiding awkward reaching to the rear of shelves during typical restocking.

Figure 5:
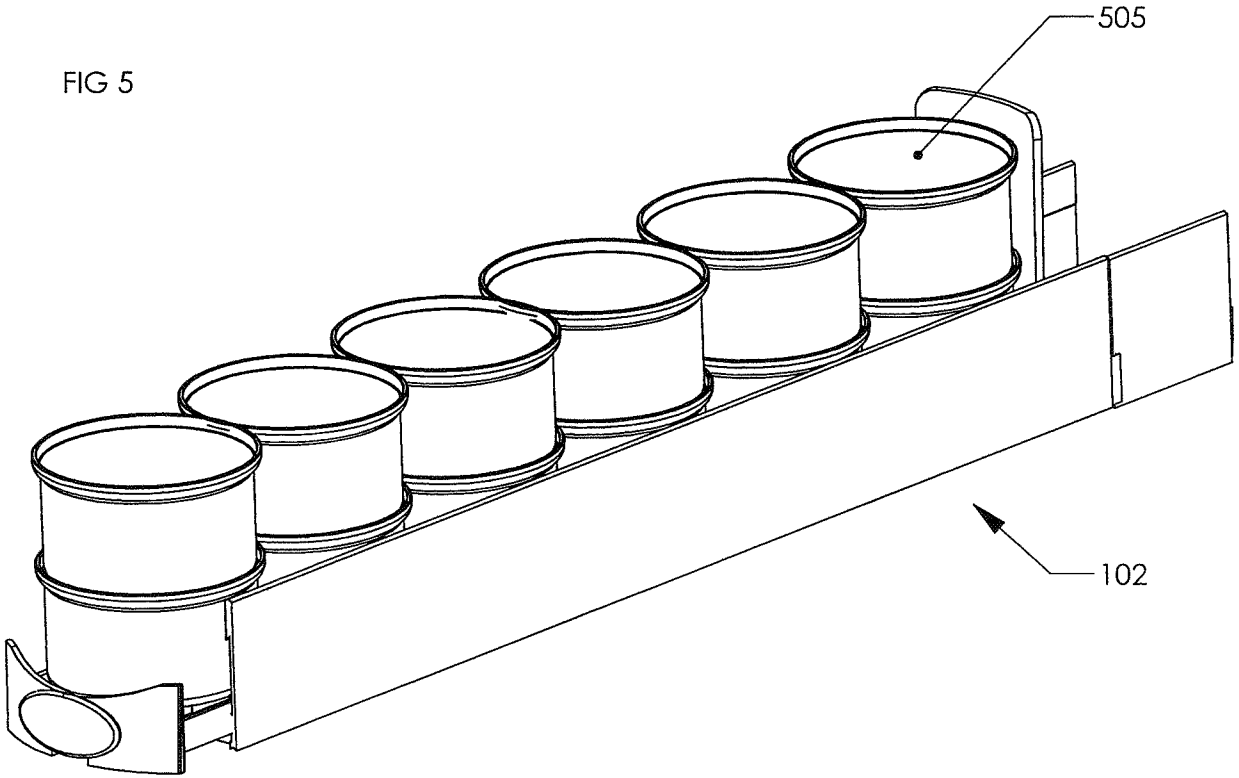
FIG. 5 illustrates products positioned in an integrated shelf allocation system of the present invention.

FIG. 5 illustrates how cans of product 505 may be positioned on an integrated shelf allocation system 102 of the present invention. FIG. 5 also illustrates an additional benefit of the present invention. As displayed, the shelving allocation unit of the present invention 102 fully contains an entire row of product. In certain embodiments, the shelving allocation unit 102 is fabricated from a material that is rigid enough to support the entire row of product 505. Accordingly, if store personnel are required to move the location of the product within the store, they merely pick up the entire shelving allocation assembly 102 without removing product 505 from the assembly. This attribute of the present invention saves store personnel a tremendous amount of time during reorganization of store shelving.

Figure 6:
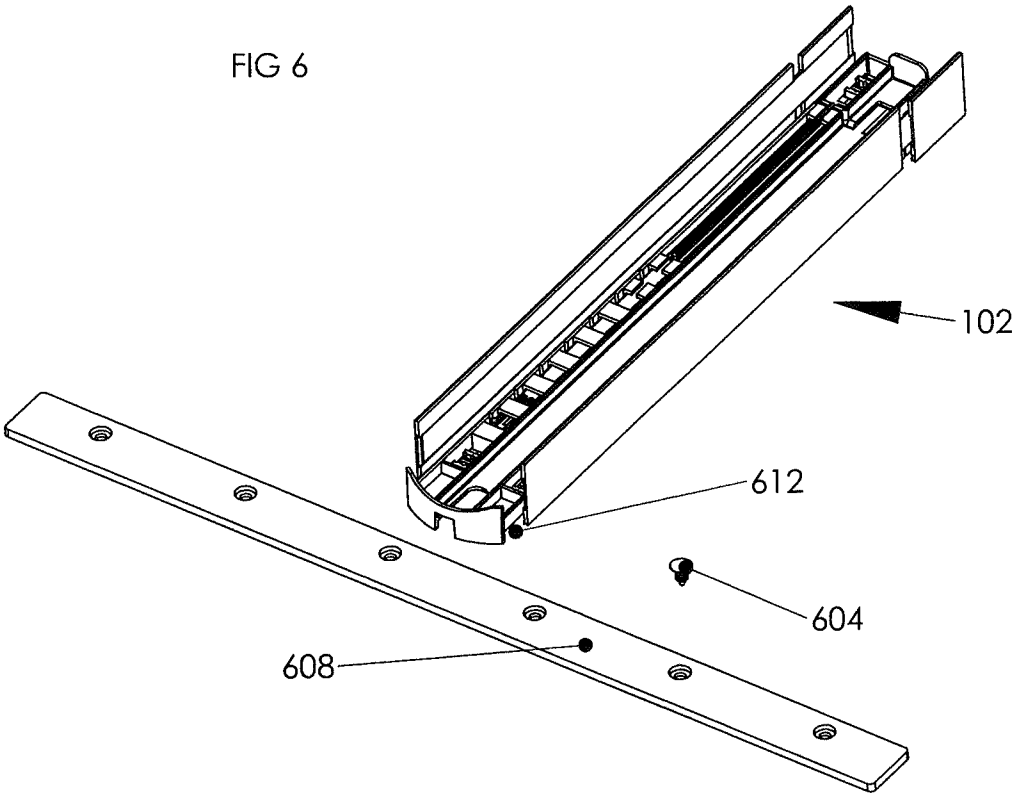
FIG. 6 displays how an embodiment of the present invention interacts with a lock-on strip to be secured to the shelving surface.

In addition to the components shown and described hereinabove, the present invention may also include a mechanism by which the integrated shelf allocation system may be secured to the shelf. In FIG. 6, a shelving allocation unit of the present invention 102 is secured to the shelf via a lock-on strip 608. The lock-on strip 608 is secured to the shelf via push pins 604 or other securing devices. The lock-on strip 608 is adapted to fit snugly into a groove 612 in the front portion of the shelving allocation unit 102.

Figure 7:
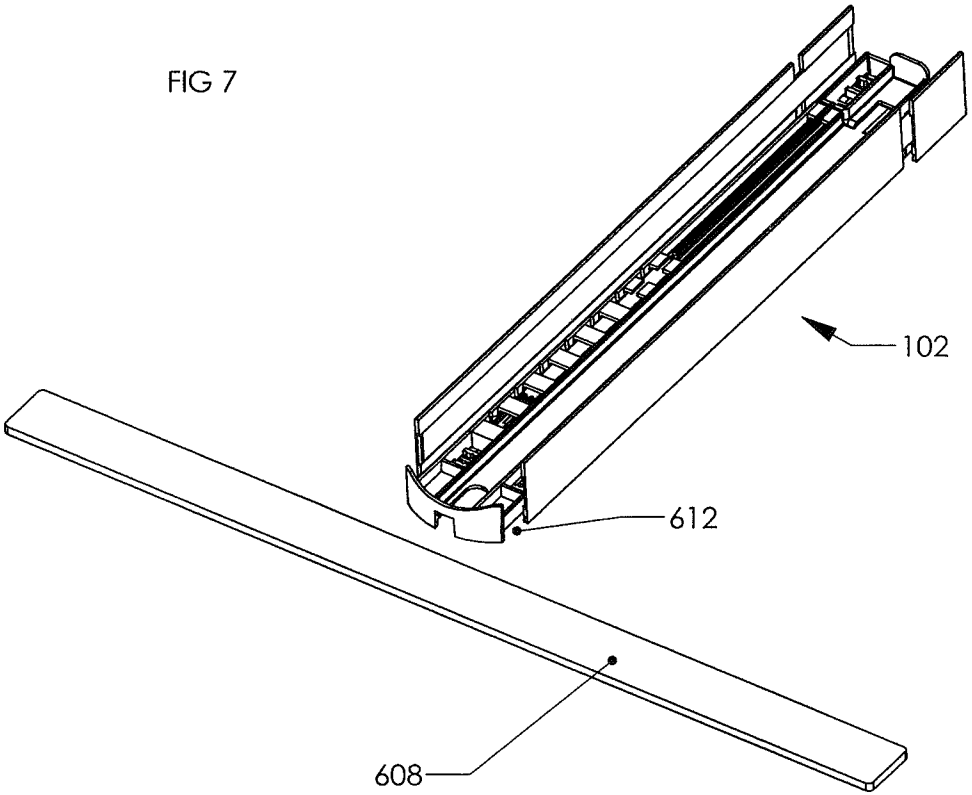
FIG. 7 displays an embodiment of the present invention that interacts with a lock-on strip that is adhesively adhered to the shelf.

Similarly, FIG. 7 displays another type of lock-on strip 708 which is secured to the shelf via double-sided tape. The groove 612 in the front of the shelving allocation unit 102 is adapted to snugly fit the lock-on strip 708 and prevent the shelving allocation unit 102 from sliding longitudinally on the shelf, thereby improving safety and improving utility in a commercial context. The lock-on functionality may also be imparted to the systems of the present invention through magnetic or Velcro means. One of the skill in the art would recognize multiple additional manners by which the assemblies of the present invention may be secured to a shelf.

Additionally, the side walls of any embodiment of the present invention may be adjustable to achieve varying heights such as by snap-on type extension to accommodate products of varying heights. Additionally, score marks may be provided on the side walls to allow for a portion of the side walls to be broken off so that the height of the side walls can be adjusted as appropriate for the shape and size of the product in the row of products. The present configuration allows one mold or manufacturing technique to produce a variety of heights of side walls.

Additionally, score marks may be provided on the backstop plate of the backstop assembly. The scores marks allow for a portion of the backstop plate to be broken off so that the height of the backstop plate can be adjusted as appropriate for the shape and size of the product in the row of products. The present configuration allows one mold or manufacturing technique to produce a variety of heights of backstop plates. Furthermore, markings may be provided on the puller member to indicate the space remaining on the shelf when the products are advanced to the front as an aid for restocking or inventory purposes.

Figure 8:
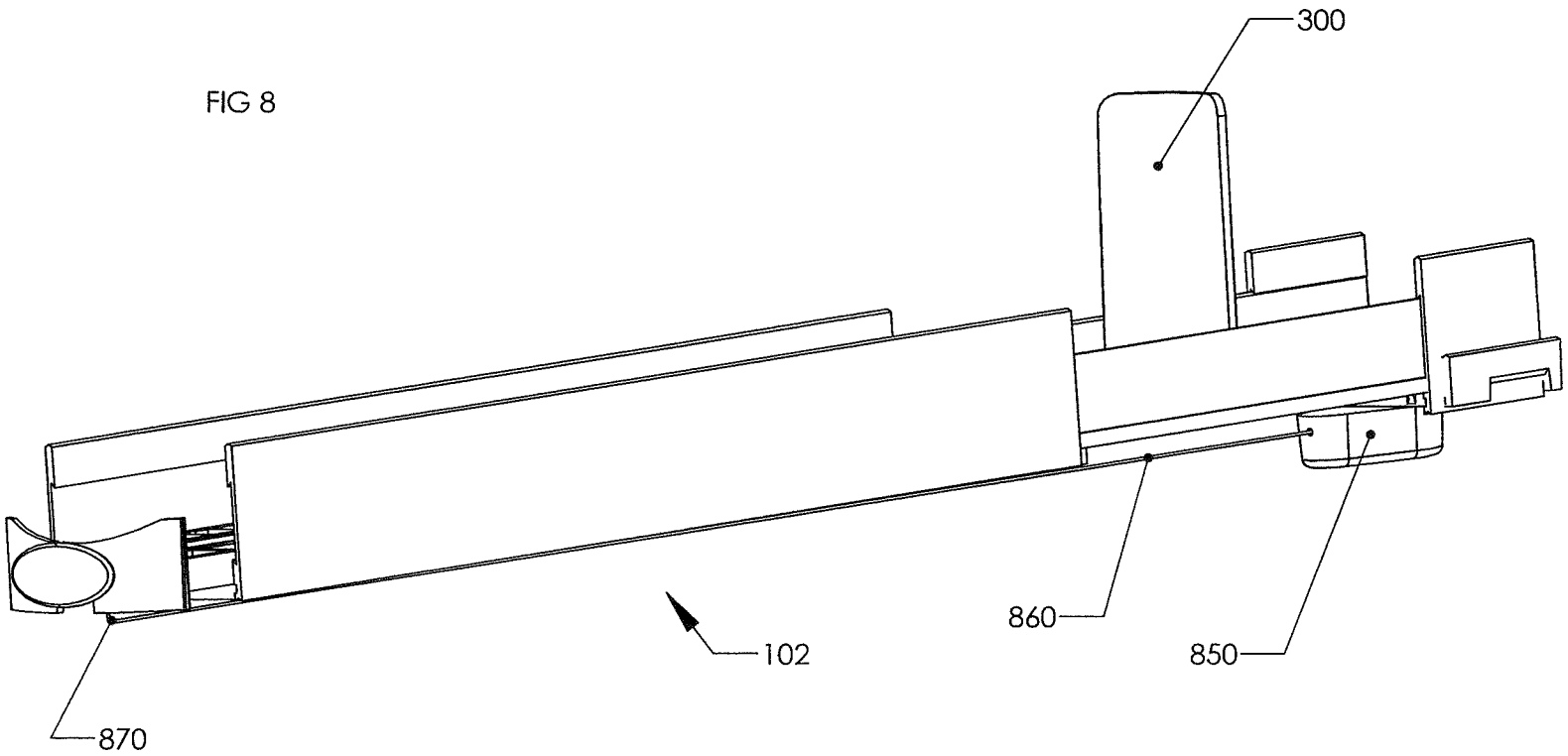
FIG. 8 displays an embodiment of the present invention in which a spring-driven mechanism is employed.

Other uses for the present invention may be contemplated. For example, the present invention may accommodate products in a variety of shapes and sizes such as jars, bottles, boxes, barrels, and drums. FIG. 8 displays an embodiment of the present invention in which a spring-based bias mechanism is employed. The spring-based mechanism includes a spring box 850 that contains a spring. The spring is connected to a spring cable 860 that runs longitudinally along the base of the shelving allocation unit to the front of the apparatus where it wraps around a hook or loop 870. From the hook or loop 870 the spring cable 860 runs towards the back of the device and attaches to the back stop assembly 300. Thus arranged, the spring-based bias mechanism would automatically draw the back stop assembly 300 and product towards the front of the shelving unit 102. In certain presently preferred embodiments of the present invention, the tension in the spring-based bias mechanism may be adjusted.

Figure 9:
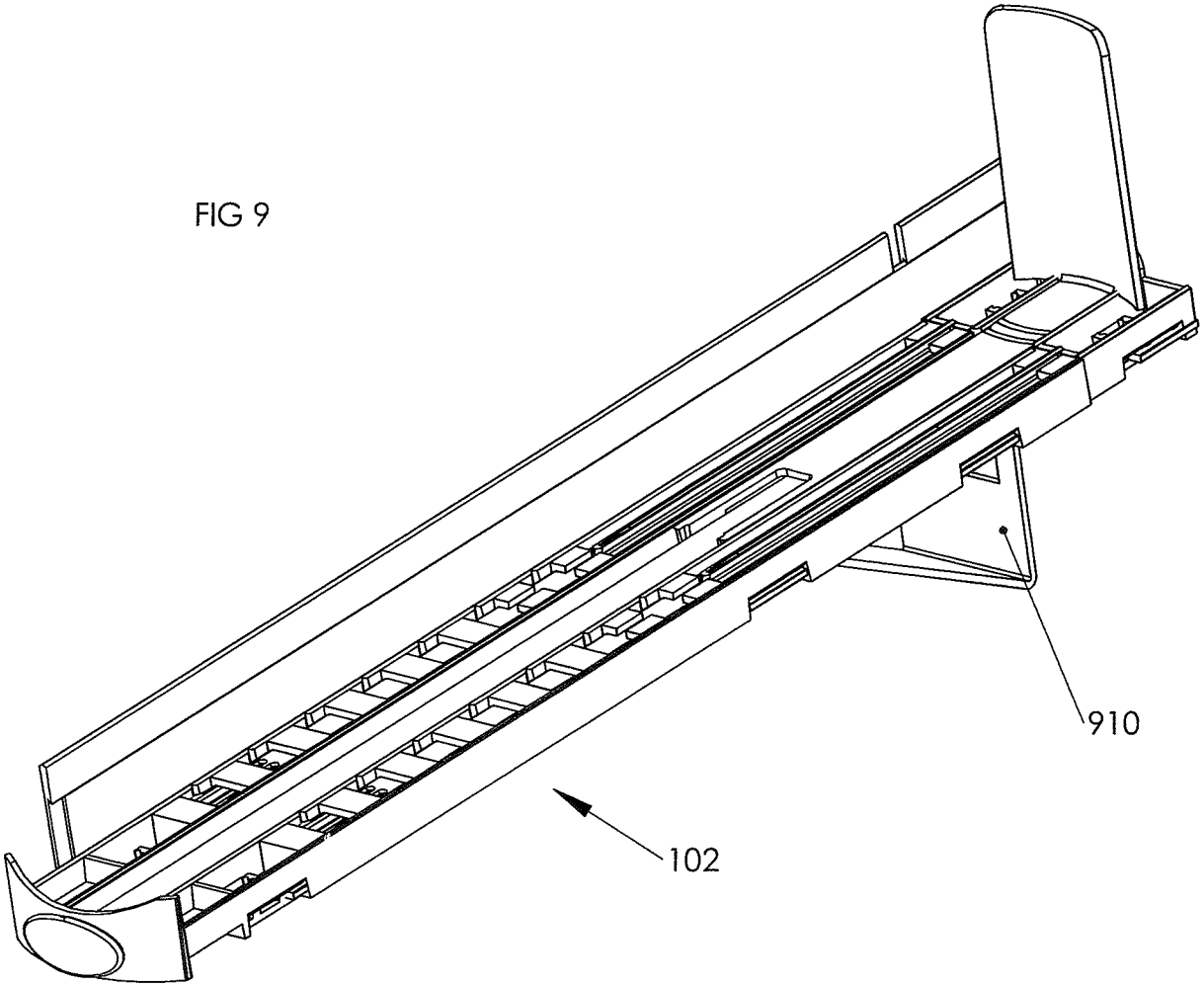
FIG. 9 shows a cut-away display of an embodiment of the present invention in which a gravity-driven mechanism is employed.

In certain presently preferred embodiments as shown in cut-away FIG. 9, the integrated shelving allocation system may be oriented such that products that are housed within the system maybe be driven to the front of the shelving unit through gravity. To achieve such functionality, the integrated shelving allocation systems of the present invention may be oriented such that the rear of the unit rests higher than the front of the unit through the use of a raised element 910. The product within the shelving unit 102 would thus be drawn to the front of the system by gravity. Such a configuration of the present system may employ a bias mechanism such as the backstop assembly disclosed hereinabove or any other mechanism to draw product toward the front of the assembly. To further promote the gravity-fed nature of the product presentation, the present invention may employ slide rails along the base of the assembly where the product resides. The slide rails would preferably reduce the friction between the product and the base of the assembly so that the product smoothly and easily slides towards the front of the assembly. A suitable material for the construction of the slide rails is Teflon. Alternatively, the base of the shelving assembly may be coated with a slip agent that may also promote smooth sliding of the product.

To take advantage of gravity-drawn product presentation, the integrated shelving management systems of the present invention preferably have the rear of the assembly raised. The rear of the assembly may be raised through the use of a vertical or angled rigid support 910 that is attached to the bottom of the rear portion of the assembly. The rigid support 910 may be reversibly or fixedly attached to the bottom of the rear of the assembly. Alternatively, the rear of the assembly 102 may be raised through the use of a support that is attached to the bottom of the assembly, much as a kickstand. When the user desires to raise the rear of the assembly, he or she may simply extend the rigid support 910.

In embodiments where the product is fed via gravity towards the front of the assembly, there is some possibility of product spilling over the front lip of the assembly due to momentum. To avoid that undesirable outcome, the present invention may also include a stabilizer that attaches to the front of the assembly. The stabilizer preferably extends vertically at the front of the assembly to prevent spillage of product. In certain preferred embodiments, the stabilizer may be spring-biased such that it is vertically oriented at rest, but may be pulled towards the horizontal direction allowing a user to restock product into the assembly. Through the spring-bias mechanism, the stabilizer would preferably return automatically to its vertical orientation following restocking of the product.

Figure 10:
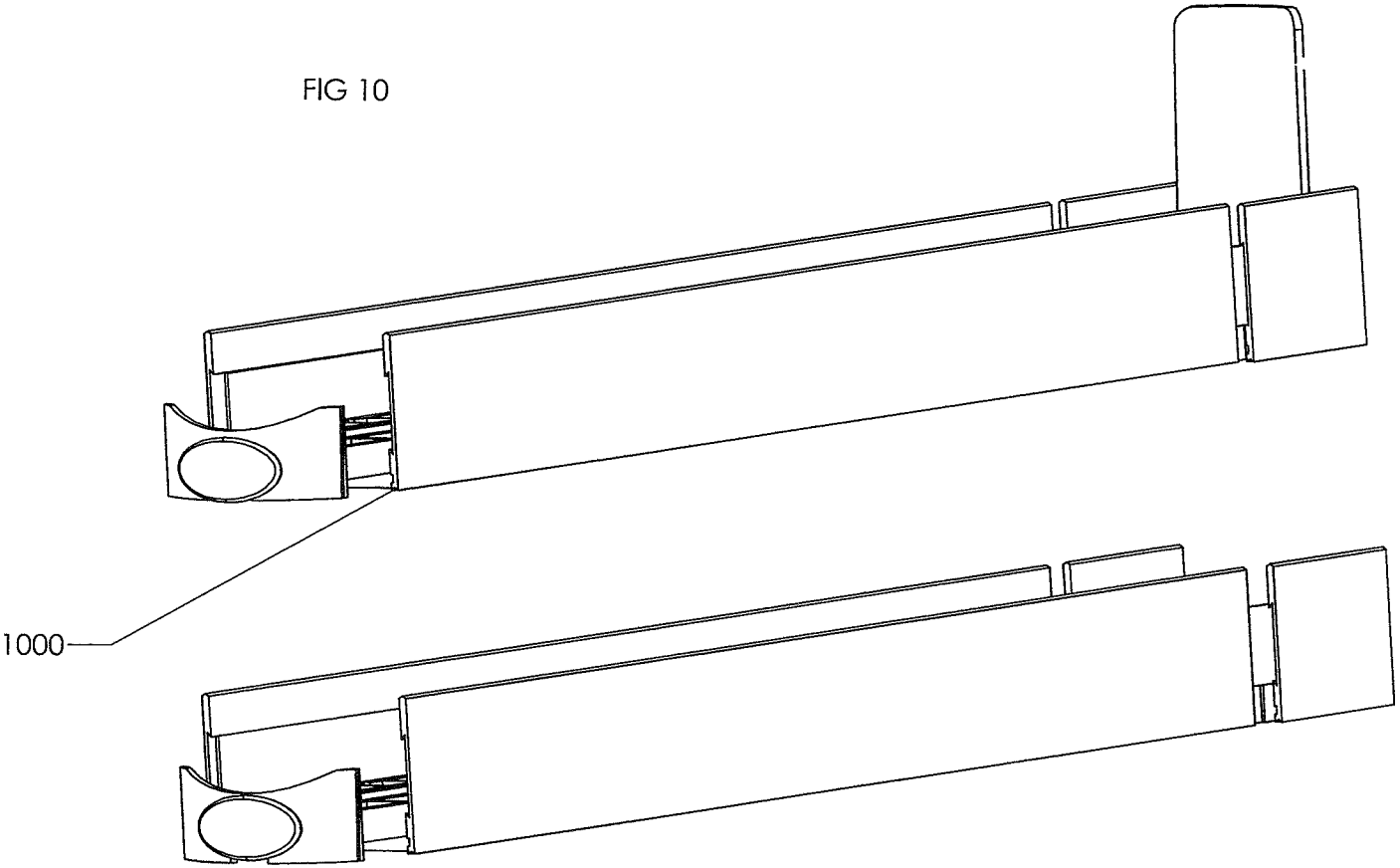
FIG. 10 displays multiple shelving units of the present invention adapted to be stacked on top of one another.

Multiple individual assemblies of the present invention may be used in tandem to provide arrays of shelving space. For example, two shelving allocation units of the present invention may be housed next to one another to accommodate varying sizes of product. In other embodiments, the shelving unit assemblies may be stacked on top of one another. Specifically, in certain preferred embodiments the bottom of the side wall components may be structured as an inverted "V" 1000 that is adapted to accommodate the top of a side wall component of another shelving unit. In that manner multiple shelving units may be stacked on top of one another through FIG. 10 displays multiple shelving allocation units of the present that are adapted to be stacked on one another.

Nothing in the above description is meant to limit the present invention to any specific materials, geometry, or orientation of elements. Many part/orientation substitutions are contemplated within the scope of the present invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered only to facilitate comprehension of the invention and should not be construed to limit the scope thereof.

What is claimed is:

1. An integrated shelf allocation management unit for allocating space among rows of products comprising:

a horizontally oriented base component that is adjustable in a longitudinal direction, said base component comprising a front base sub-component and a rear base sub-component forming an integrated base component coupling mechanism, wherein said base component coupling mechanism comprises a pair of extended arms on a left and right side of a front end of said rear base sub-component that includes extensions that project laterally from a front end of said extended arm, wherein said pair of extended arms are adapted to fit into a pair of complementary grooves on said front base sub-component, further wherein said front base sub-component further includes a series of notches adapted to accept said extensions such that the front base sub-component and rear base sub-component may be combined to form an integrated base component having a length specified by the coupling of said first base sub-component and said second base sub-component through said extensions and said notches; and two vertically oriented side wall components disposed at a left and right side of said base component that are adjustable in a longitudinal direction wherein said two side wall components and said base component may be integrated into a single integrated shelf allocation management system through a coupling mechanism adapted to allow the distance between the two side wall components to be adjusted, wherein said coupling mechanism comprises a plurality of width adjustment tabs oriented perpendicularly to the longitudinal axis and disposed along a length of said side wall components at a plurality of distances from the front of the side wall components, where the tabs fit snugly into a plurality of complementary grooves located in said base component disposed along a length of the base component at the plurality of distances from the front of the base component, wherein the complementary grooves are perpendicular to the longitudinal axis and where the distance between the two side wall components may be adjusted by changing the depth to which the plurality of tabs penetrates the plurality of complementary grooves.

2. The unit of claim 1, wherein each of the side wall components includes a front side wall sub-component and a rear side wall sub-component, further wherein said front side wall sub-component includes said complementary groove adapted to accommodate said extended arm of said rear side wall sub-component thereby coupling said rear side wall sub-component and said front side wall sub-component to form a side wall component.

3. The unit of claim 1, wherein said base component includes a pair of raised rails that form a channel that runs longitudinally down the center of said base component.

4. The unit of claim 3, wherein said base component further includes a vertically oriented front barrier element located at the front edge of said base component and a vertically oriented rear barrier element located at the rear edge of said base component.

5. The unit of claim 4, wherein said front barrier element includes a hole at the base of said front barrier element that has a width that is approximately the width of said channel.

6. The unit of claim 5, further comprising a backstop assembly positioned between said side wall components and disposed in said channel, said backstop assembly comprising a backstop base and a back plate located at a distal end of said backstop base, wherein said backstop base includes a central backstop channel.

7. The unit of claim 6, wherein said backstop assembly further comprises a puller member adapted to slideably engage said backstop assembly base.

8. The unit of claim 7, wherein said puller member is disposed within said central backstop channel.

9. The unit of claim 8, wherein said puller member comprises an engaging portion at a distal end of said puller member, said engaging portion adapted to engage a front portion of said backstop assembly base.

10. The unit of claim 9, wherein said puller member is adapted to disengage from said backstop assembly when said puller member is pushed along the longitudinal direction toward the rear of said system.

11. The unit of claim 1, further comprising a bias mechanism adapted to drive said product to the front of said system.

12. The unit of claim 11, wherein said bias mechanism is gravity-drive or spring driven.

13. The unit of claim 12, wherein said gravity driven mechanism comprises a raised element at the rear of said system.

14. The unit of claim 13, further comprising a product stabilizer located at the front of said system and adapted to limit spillage of said product from said system.

15. A shelving management system, comprising multiple units according to claim 1, wherein said multiple units according to claim 1 are adapted to be stacked vertically on top of one another.

16. The unit of claim 1, further comprising a rigid support placed under the rear of said unit to promote gravity-driven movement of said product to the front of said unit.

* * * * *